US007181321B2

(12) United States Patent
Schlicker et al.

(10) Patent No.: US 7,181,321 B2
(45) Date of Patent: Feb. 20, 2007

(54) METHOD AND DEVICE FOR OPERATING A MULTIPLE COMPONENT TECHNICAL SYSTEM, PARTICULARLY A COMBUSTION SYSTEM FOR PRODUCING ELECTRICAL ENERGY

(75) Inventors: Stefan Schlicker, Höchstadt (DE); Roland Schreiber, Lauterbach (DE)

(73) Assignee: Siemens Aktiengesellschaft, Munich (DE)

( * ) Notice: Subject to any disclaimer, the term of this patent is extended or adjusted under 35 U.S.C. 154(b) by 664 days.

(21) Appl. No.: 10/451,237

(22) PCT Filed: Dec. 12, 2001

(86) PCT No.: PCT/EP01/14601

§ 371 (c)(1),
(2), (4) Date: Jun. 20, 2003

(87) PCT Pub. No.: WO02/052199

PCT Pub. Date: Jul. 4, 2002

(65) Prior Publication Data

US 2004/0161715 A1 Aug. 19, 2004

(30) Foreign Application Priority Data

Dec. 22, 2000 (EP) ..... 00128305

(51) Int. Cl.

| | |
|---|---|
| ***G05D 23/00*** | (2006.01) |
| ***G06F 19/00*** | (2006.01) |
| ***G06F 15/46*** | (2006.01) |
| ***G05B 13/02*** | (2006.01) |

(52) U.S. Cl. ..... 700/297; 700/287; 700/291; 323/271

(58) Field of Classification Search ..... 700/287, 700/291, 295, 32, 33, 297; 431/60; 60/241, 60/233; 323/271, 283, 285
See application file for complete search history.

(56) References Cited

U.S. PATENT DOCUMENTS

| | | | | |
|---|---|---|---|---|
| 3,797,988 | A | 3/1974 | Davidson | 431/12 |
| 3,932,735 | A * | 1/1976 | Giras | 700/287 |
| 3,939,328 | A * | 2/1976 | Davis | 700/41 |

(Continued)

FOREIGN PATENT DOCUMENTS

JP 61 285314 A 12/1986

(Continued)

OTHER PUBLICATIONS

"Recent applications of CFD modelling in the power generation and combustion industries" -Stopford, PJ. AEA Technology Engineering Software, Nov. 2001.*

(Continued)

*Primary Examiner*—Michael D. Masinick
(74) *Attorney, Agent, or Firm*—Harness, Dickey & Pierce, P.L.C.

(57) ABSTRACT

In a technical system a plurality of values associated respectively with a component are stored in at least one computer unit. The computer unit is enabled to trigger an evaluation of at least one other component with a value when a component begins or terminates operation, and the values of each component are added. The computer unit is also enabled to determine which components should be started or stopped based on the added values.

6 Claims, 3 Drawing Sheets

U.S. PATENT DOCUMENTS

Figure 1:
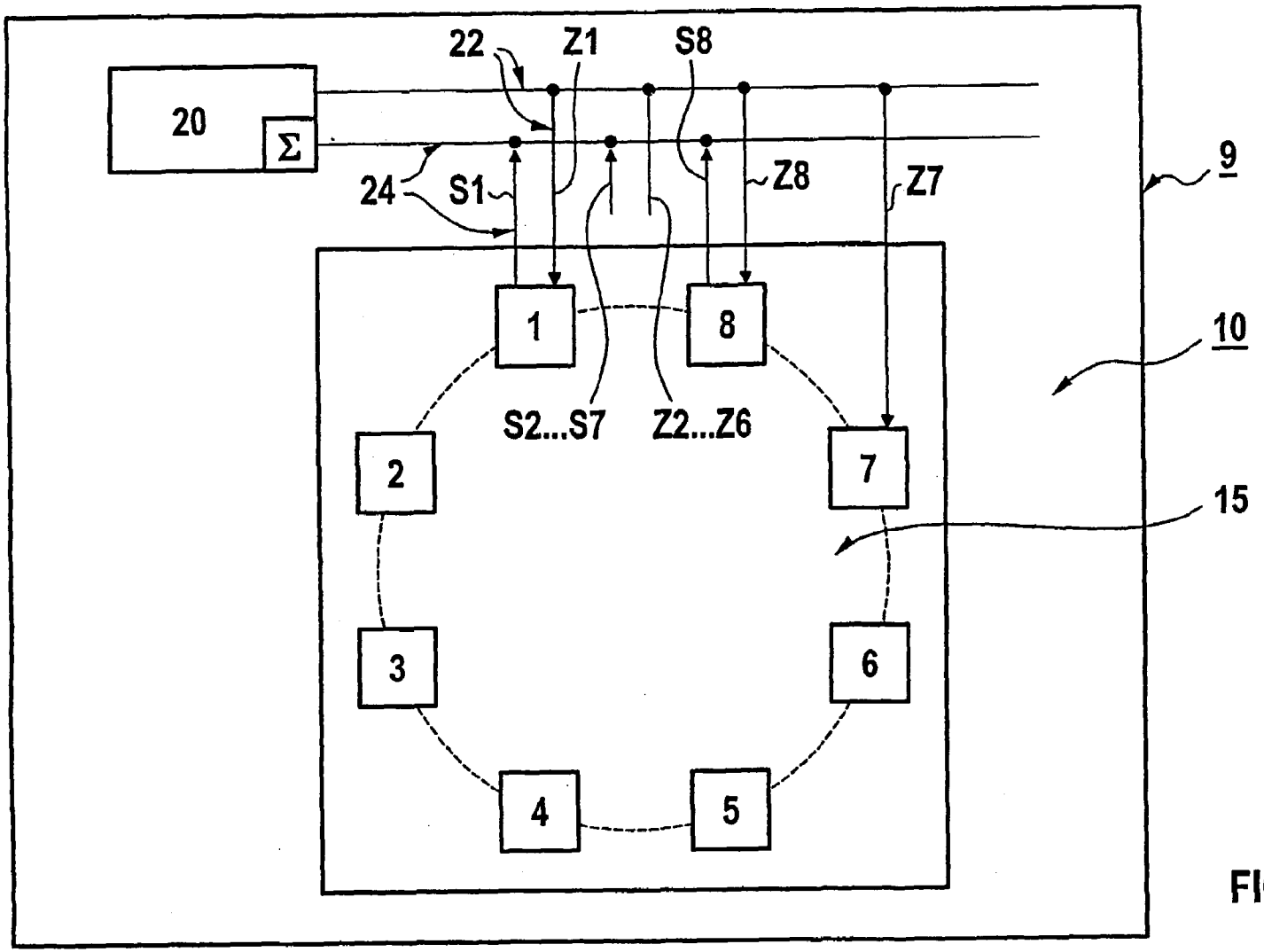

| | | | | |
|---|---|---|---|---|
| 4,013,877 | A * | 3/1977 | Uram et al. | 700/6 |
| 4,536,126 | A * | 8/1985 | Reuther | 290/40 R |
| 5,715,764 | A * | 2/1998 | Lyngfelt et al. | 110/245 |
| 6,381,504 | B1 * | 4/2002 | Havener et al. | 700/44 |
| 6,633,823 | B2 * | 10/2003 | Bartone et al. | 702/57 |
| 6,901,351 | B2 * | 5/2005 | Daw et al. | 702/188 |

FOREIGN PATENT DOCUMENTS

| | | | |
|---|---|---|---|
| JP | 01 102213 | A | 4/1989 |
| JP | 08 210628 | A | 8/1996 |
| JP | 09 236251 | A | 9/1997 |

OTHER PUBLICATIONS

"Micro-Power Generation Using Combustion: Issues and Approaches" -Fernandez-Pello, A Carlos. UC Berkley Department of Mchanical Engineering.*

* cited by examiner

METHOD AND DEVICE FOR OPERATING A MULTIPLE COMPONENT TECHNICAL SYSTEM, PARTICULARLY A COMBUSTION SYSTEM FOR PRODUCING ELECTRICAL ENERGY

This application is the national phase under 35 U.S.C. § 371 of PCT International Application No. PCT/EP01/14601 which has an International filing date of Dec. 12, 2001, which designated the United States of America and which claims priority on European Patent Application number EP 00128305.0 filed Dec. 22, 2000, the entire contents of which are hereby incorporated herein by reference.

FIELD OF THE INVENTION

The present invention generally relates to a method for operating a technical installation which includes a number of components. The present invention also generally relates to a device for operating an installation that include a number of components. The technical installation may be a combustion installation for generating electrical energy.

BACKGROUND OF THE INVENTION

Technical installations generally include a number of components, which for example either each realize a specific function of the technical installation or together perform a certain function.

An example of a technical installation in which components with different functions act together is, for example, a power plant for generating electrical energy. To be able to generate electrical energy in a technical installation of this type, interaction between numerous components each with a different task is necessary.

Some of these components may include turbines, generators, protective systems and control systems. Efficient operation of a technical installation of this type is possible if use of the components mentioned is coordinated.

In modern technical installations, interaction between the components of the technical installation is usually coordinated and monitored by a computer-aided control system. The degree of automation is in this case often very high, so that human intervention in the operation of the technical installation is only necessary if the automatic control has to deal with a current operating state of the technical installation for which no solution or procedure is provided in the control programs of the control system. This may for example include incidents which could not be taken into account in every detail when the control system was designed, but also operational transitions during operation of the technical installation that in themselves are simple, from a human viewpoint, but which often can only be reproduced as technical control-related programs with considerable effort. This may be the case, for example, whenever a large number of possible operating states can occur during the operation of the technical installation and it is intended to be possible to achieve a desired operating state from each of these operating states.

A control program would then have to contain for each of these possible operating states associated control instructions to go to the desired operating state. The recording of all possible operating states of a technical installation in a control program is often not possible in advance, so that in some cases the operating personnel of the technical installation have to take over operating the components of the technical installation manually.

In the case of a technical installation in which a number of components act together to perform a certain function, the previously described problems are similar. An example of a technical installation of this type is a combustion installation for generating electrical energy, which includes a number of burners arranged in a combustion chamber. Use of the burners is in this case to take place in such a way that the fuel supplied is used as efficiently as possible, in order to generate a required amount of electrical energy and to operate the installation economically. Furthermore, conservative operation of an installation of this type is also a desired objective, which can be achieved for example by uniform distribution of the burning in the combustion chamber.

To use the fuel supplied as efficiently as possible, it is necessary, in particular when starting up and shutting down the technical installation and in part-load operation, that is when the maximum possible amount of electrical energy that can be generated by the combustion installation is not being demanded and not all the burners are firing simultaneously, to switch the burners on or off selectively in such a way that the most uniform possible distribution of burning in the combustion chamber is ensured at each point in time of the operation of the technical installation.

Practical operation of many power plants shows that, for example in the case of the solution to the aforementioned problem of uniform distribution of burning in a combustion chamber, automatic switching on and off of the main burners is often relinquished, since the logic or step controllers usually used for accomplishing such tasks can only be realized with very great effort. Additionally, the control programs that can be used for such purposes may be very complicated. The reason for the great amount of effort is that, when operating a combustion installation with a number of burners, virtually every operating state between no load and full load, including the associated starting-up and shutting-down procedures, may be applicable. A control program would then have to be able to execute corresponding control instructions for each of these numerous operating states to ensure efficient operation of the technical installation.

To avoid at least partly the problem described of great effort being expended, logic and step controllers, in which corresponding control commands are provided only for a subset of all the possible operating states, are in use in many power plants. By this deliberate restriction to defined operating cases, such controllers are less flexible and human intervention continues to be necessary for all those operating cases for which no control commands are provided in the controllers.

In order to solve the problem of uniform distribution of the burning in a combustion chamber of a combustion installation, also conceivable are solutions in which additional measuring devices are provided, for example for measuring the temperature profile in the combustion chamber, in order then to evaluate these measurements and consequently control use of the burners.

A disadvantage of this is that additional devices, such as the measuring devices for determining the temperature profile, are necessary. Furthermore, these additional measurements have to be evaluated, in order to derive from them control commands for use of the burners. The additional effort is in this case is often considerable. Moreover, the adding of additional measuring devices imposes sources of problems on the technical installation, which in the event that they do not function can lead to the technical installation shutting down.

SUMMARY OF THE INVENTION

An object of the present invention is to provide a method and a device for operating an installation that includes a number of components, in particular a combustion installation for generating electrical energy, which permit the most economical possible operation of the technical installation.

An object of the present invention is achieved whereby:

1. Each component commencing or ceasing to operate continually triggers an assessment of at least one other component with a numerical value,
2. The numerical values of each component are summated, and
3. The components which are next to be switched on or off are determined from the numerical values summated.

An aspect of a method according to the present invention is that the operating state of the components of a technical installation is described by a number of numerical values which are respectively assigned to a component. The numerical values may in this case be, for example, decimal numbers. A change in the operating state of the technical installation due to components commencing or ceasing to operate results in a change in at least one numerical value of at least one component of the technical installation. The total of the numerical values of all the components at a certain operating time consequently describes the current operating state of the technical installation.

The summated numerical values of each component, dependent on the value of this sum, express a priority with which the components concerned are next to be switched on or off in order to arrive at a desired operating state.

Therefore, a method according to the present invention is a method in which the operating state of a technical installation and changes in the operating state are expressed by a number of numbers, for example decimal numbers, which are further processed (summation) in order to determine from them the next operating state of the technical installation.

In this way, realization of a uniform operating profile, for example a symmetrical flame profile, may be achieved even under disadvantageous operating conditions. For example, an unsymmetrical geometric arrangement of the burners and/or different burner outputs (for example of the pilot and main burners).

The components may advantageously be of the same type as one another.

In the case where the components are of the same type as one another, this has the effect that the assessment of at least one other component with a numerical value when there are changes in the operating state is particularly simple, since the values of the numerical values with which the components concerned are assessed do not have to be dependent on the function of a component per se, but only on the role of the component concerned which the latter plays in a certain operating state of the technical installation with regard to desired economical operation of the installation. This development means that, when establishing the values of the numerical values with which the assessment of other components takes place, less effort has to be expended, since peculiarities by which the components could be distinguished from one another do not have to be taken into account.

In an embodiment of the present invention, a uniform, in particular symmetrical, spatial distribution of components that are in operation is achieved by the switching on or off of components.

If the components of the technical installation are, for example, actuators, which exert forces for example on a raw material to be processed, on a positioning device or conveying devices or the like, a uniform spatial distribution of those actuators which exert a force specifically in a certain operating state is advantageous, since the loading of the material concerned or the device concerned is in this case more favorable in comparison with nonuniform loading. In particular, nonuniform loading may create undesired deformations, ruptures or even destruction can occur, for example as a consequence of internal stresses caused by force gradients.

If the technical installation is a combustion installation with a number of bumers, which are arranged for example along the inside wall of a combustion chamber, a spatial distribution of burners that are in operation is may be advantageous, since as a result a homogeneous temperature profile is achieved in the combustion chamber and as a result the fuel supplied is used particularly efficiently and the installation is operated in an economical and material-conserving manner.

In yet another embodiment of the present invention, components which are respectively arranged virtually at the same spatial distance from the component commencing or ceasing to operate are assessed with the same numerical value.

In this way a uniform spatial distribution of components that are in operation can be achieved particularly easily, since it is already taken into account in the assessment of the components that components spaced equally from a reference point, that is the arrangement location of a component to be switched on or off, are assessed the same. Accordingly, the desired equal spatial distribution is already included in the assessment and not only taken into account during or after the further processing of the numerical values (summation).

As already stated, the assessment is, for example, particularly advantageous whenever force is exerted by the components of an installation on a raw material, a product or a device, since a uniform exposure to force in this case minimizes risks to the raw material, the product or the device. Similarly, an assessment of this type is advantageous in the case of the already mentioned combustion installation with a number of burners arranged in a combustion chamber, since a uniform distribution of burners that are in operation is also desired here with regard to a uniform temperature profile in the combustion chamber, and can easily be achieved in this way.

In addition, an object of the present invention is to provides a number of numerical values respectively assigned to a component to be stored in at least one arithmetic unit, the arithmetic unit being made able to trigger an assessment of at least one other component with a numerical value when a component commences or ceases to operate and to summate the numerical values of each component, and by the arithmetic unit also being made able to determine from the summated numerical values those components which are next to be switched on or off.

The may be components advantageously of the same type as one another.

It is also advantageous that a uniform, in particular symmetrical, spatial distribution of components that are in operation is achieved by the switching on or off of components.

In yet another embodiment of the present invention, those components which are respectively arranged at the same spatial distance from the component commencing or ceasing to operate are assessed with the same numerical value.

Further scope of applicability of the present invention will become apparent from the detailed description given hereinafter. However, it should be understood that the detailed description and specific examples, while indicating exemplary embodiments of the present invention, are given by way of illustration only, since various changes and modifications within the spirit and scope of the invention will become apparent to those skilled in the art from this detailed description.

Figure 2:
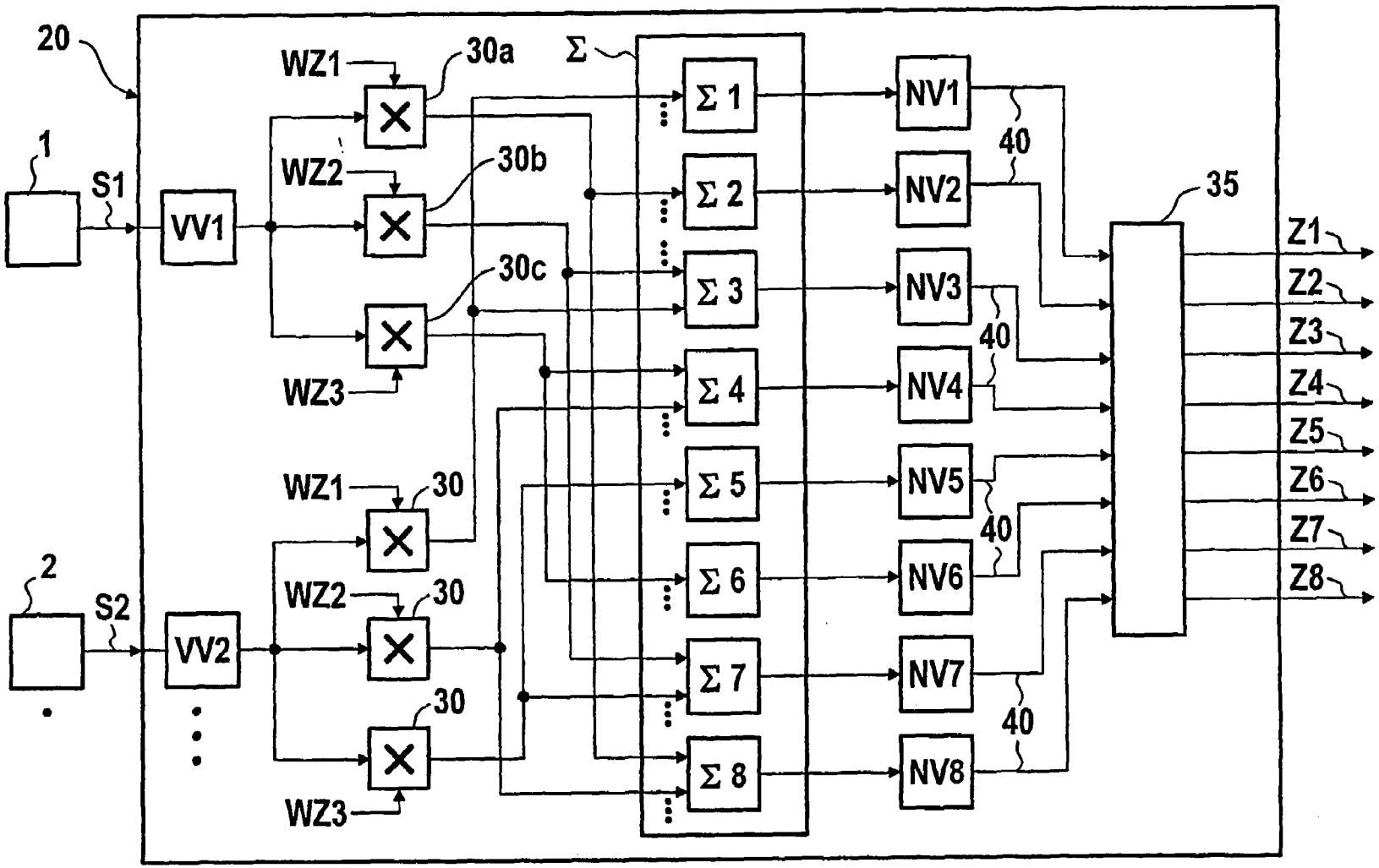
Figure 3:
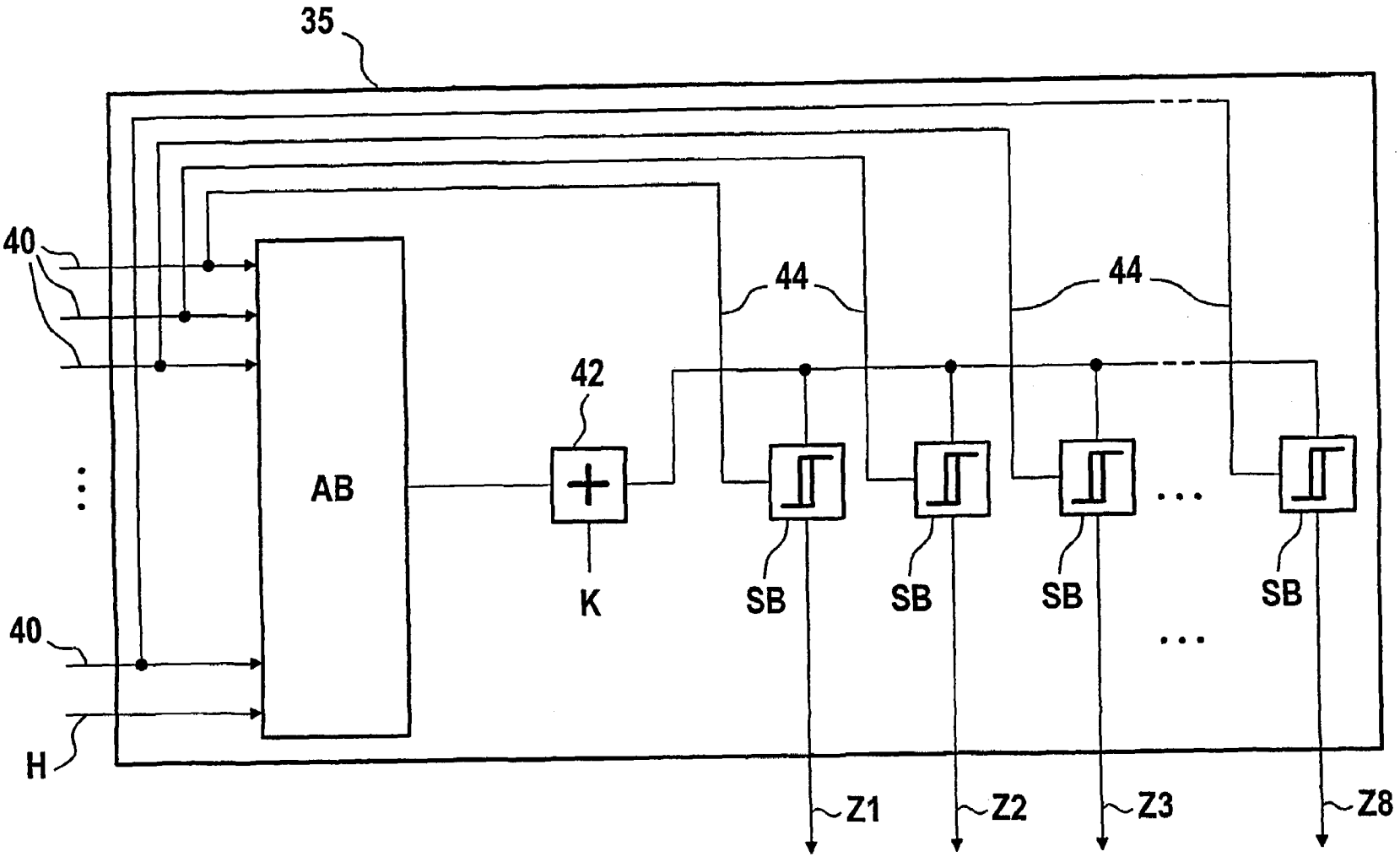

The present invention will become more fully understood from the detailed description given hereinbelow and the accompanying drawings which are given by way of illustration only, and thus are not limitative of the present invention, and wherein:

1. FIG. 1 illustrates a combustion installation which includes a number of burners arranged along the inside wall of a combustion chamber;

2. FIG. 2 illustrates a schematic representation of the assessment of other components when burners of the combustion installation according to FIG. 1 have been switched on; and 3. FIG. 3 illustrates an exemplary embodiment of the processing unit according to FIG. 2.

DETAILED DESCRIPTION OF THE EXEMPLARY EMBODIMENTS

Represented in FIG. 1 is a device 9 for operating a technical installation 10, the latter comprising components 1, 2, 3, . . . 8, which are formed as burners and are arranged in a combustion chamber 15.

The device 9 includes an arithmetic unit 20, which is connected to the burners 1, 2, 3, . . . 8 via command lines 22 and sensor lines 24.

Via the sensor lines 24, the arithmetic unit 20 respectively receives from the burners 1, 2, 3, . . . 8 their operating state values S1, S2, S3, . . . S8. These operating state values contain, for example, information on whether the respective burner is switched on or off at the time.

In the arithmetic unit 20, the operating state values S1, S2, S3, . . . S8 are evaluated, in order in particular to establish a commencement or cessation of the operation of one or more burners. If this is the case, at least one other burner is assessed with a numerical value in the arithmetic unit 20.

Consequently, every change in operating state triggers an assessment as a consequence of the commencement or cessation of the operation of burners 1, 2, 3, . . . 8, so that at every operating time of the technical installation each burner is assessed with a number of numerical values, which are stored in the arithmetic unit 20.

The arithmetic unit 20 includes a summation unit 1, which respectively summates for each burner its numerical values assigned at that time.

The summated numerical values of each burner 1, 2, 3, . . . 8 respectively describe for each burner a priority, with which a certain burner is next to be switched on or off.

The arithmetic unit 20 also determines from these priorities commands Z1, Z2, Z3, . . . Z8, which are output to the burners 1, 2, 3, . . . 8. These commands may be, for example, switch-on or switch-off commands to the individual burners, in order constantly to ensure economical operation of the technical installation 10.

FIG. 2 shows by way of example for the case in which burners 1 and 2 of the combustion installation according to FIG. 1 have been switched on the assessment of other burners triggered as a result.

The arithmetic unit 20 respectively receives from the burners 1 and 2 their operating state values S1 and S2, which in the present case carry at least the information that the burner 1 or 2 concerned has been switched on.

The operating state values S1 and S2 are switched to signal preprocessing stages VV1 and VV2, respectively, of the arithmetic unit 20. The signal preprocessing stages take the aforementioned information from the operating state values S1 and S2 and assign an operating state value, for example the constant value 1, to the operating state applicable by way of example of burners 1 and 2 switched on.

The operating state value of each burner is switched to multipliers 30 assigned to the respective burner. As a further input signal, these multipliers respectively also receive at least one numerical value WZ1, WZ2 and WZ3.

These numerical values WZ1, WZ2 and WZ3 may correspond for example to the constant values 6, 3 and 1, respectively.

In the present case, the switched-on burner 1 triggers an assessment of the other burners 2, 8, 3, 7, 4 and 6; the switched-on burner 2 triggers an assessment of the other burners 1, 3, 4, 8, 5 and 7.

The assessment by the switched-on burner 1 takes place in the present exemplary embodiment by the summators Σ2, Σ8, Σ3, Σ7, Σ4 and Σ6, respectively assigned to the other burners 2, 8, 3, 7, 4 and 6, receiving the output signals of the multipliers 30 as input signals, as represented in FIG. 2.

Each of the summators Σ1, Σ2, Σ3, . . . Σ8 summates its associated input signals and transfers the respective sum value to downstream signal postprocessing stages NV1, NV2, NV3, . . . NV8. In the signal postprocessing stages there can take place, for example, a postprocessing of the output signal of the respective summator Σ1, Σ2, Σ3, . . . Σ8, in that for example the output of the summator arranged upstream of the respective signal postprocessing stage is switched through to a processing unit 35 arranged downstream of the signal processing stages only whenever the burner assigned to the respective signal postprocessing stage or the respective summator is not in operation; if the respective burner is already in operation, the signal postprocessing stage concerned can, for example, instead of the output value of the respective summator, transfer to the processing unit a different value as the current assessment 40. This value may, rather, be chosen such that the processing unit 35 detects burners that are already in operation and consequently prevents them from receiving a (useless) switch-on command as the command Z1, Z2, Z3, . . . Z8.

The main task of the processing unit 35 is to determine from the output signals of the signal postprocessing stages NV1, NV2, NV3, . . . NV8 those burners which are next to be switched on or off by means of the commands Z1, Z2, Z3, . . . Z8. Whether the respective command Z1, Z2, Z3, . . . Z8 is a switch-on or switch-off command depends on the next operating state into which the technical installation is to change over from its current operating state, in order for example to achieve economical operation of the installation. If the installation is to be brought from a current operating state into an operating state which requires a higher firing output, the processing unit 35 determines switch-on commands as commands Z1, Z2, Z3, . . . Z8 for the burners, in order to achieve economic operation of the installation, for example by switching on those burners which, in combination with the burners already switched on, ensure a homogeneous temperature profile in the combustion chamber 15.

If, on the other hand, starting from the current operating state, an operating state which requires a lower firing output is required, the processing unit 35 determines switch-off commands as commands Z1, Z2, Z3, . . . Z8 for the burners, so that burners that are in operation are selectively switched off in such a way that the remaining burners that are in operation ensure economical operation of the technical installation, in that they produce for example a high temperature profile in the combustion chamber.

The processing unit 35 is consequently made able, specifically according to the requirement for a next operating state, to generate both switch-on and switch-off commands as commands Z1, Z2, Z3 . . . Z8.

For further illustration, the assessment explained by way of example in FIG. 2 is now to be shown with actual figures for the numerical values WZ1, WZ2 and WZ3 and also for the outputs of the signal preprocessing stages VV1 and VV2.

The burners 1 and 2 are assumed to have been switched on. This is indicated to the signal preprocessing stages VV1 and VV2, respectively, by way of the operating state values S1 and S2. The signal preprocessing stage VV1 generates from the operating state value S1 of the burner 1 the value one and switches the latter according to FIG. 2 to three of the multipliers 30. The multiplier 30*a* serves for the assessment of the two burners 2 and 8 neighboring the burner 1, the multipliers 30*b* and 30*c* serve for the assessment of the burners 3 and 7, and 4 and 6, respectively. The burner 5 is not assessed, or assessed with the numerical value zero, by the burner 1. The values fed as multipliers WZ1, WZ2, WZ3 to these three multipliers 30*a*, 30*b*, 30*c* are assumed to be the constant values six, three and one, respectively. These values correspond approximately to the influence of the burners to be assessed on the unsymmetry of the flame profile, i.e. the distances of the assessing burner 1 from the burners to be assessed. The output of the multiplier 30*a* consequently supplies the value six and feeds it to the summator Σ2 (which is assigned to the burner 2) and the summator Σ8 (which is assigned to the burner 8).

The output of the multiplier 30*b* supplies the value three, which is switched to the summators Σ3 (which is assigned to the third burner) and Σ7 (which is assigned to the seventh burner).

The output of the third multiplier 30*c* supplies the value one, which is switched to the summator Σ4 (which is assigned to the fourth burner) and to the summator Σ6 (which is assigned to the sixth burner).

The assessment of the other burners triggered by the burner 2 is to take place in an analogous way, so that the value six is switched to the summators Σ1 and Σ3, the value three is switched to the summators Σ4 and Σ8 and the value one is switched to the summators Σ5 and Σ7.

As output values, the summators Σ1, Σ2, Σ3, Σ4, Σ5, Σ6, Σ7 and Σ8 determine by summation the values six, six, nine, four, one, one, four and nine, respectively. These values are switched to the correspondingly following signal postprocessing stages NV1, NV2, NV3, . . . NV8.

In the case of a next operating state to be reached, an increase in the firing output is assumed to be required, so that switch-on commands are determined by the processing unit 35 as commands Z1, Z2, Z3 . . . Z8 for the burners, in such a way that the burners that are in operation in the next operating state have a uniform spatial distribution in the combustion chamber 15, in order as a result to achieve a homogeneous temperature profile.

Since the burners 1 and 2 are already in operation, the signal preprocessing stages VV1 and VV2 do not switch the outputs of the summators Σ1 and Σ2 to the processing unit 35, but for example to the constant value thousand; the outputs of the other summators Σ3, Σ4, Σ5, . . . Σ8 are switched unchanged to the processing unit 35 by the following signal postprocessing stages NV3, NV4, NV5, . . . NV8.

In the present example, the processing unit 35 consequently has eight input signals at its disposal to determine the burners to be switched on in the next step.

In the case of the choice of the numerical values WZ1, WZ2 and WZ3 represented by way of example, the processing unit 35 can then determine the burners to be switched on in the next step in that it determines the minimum or minima of their input values and, in the next step, switches on the burners respectively associated with these minima; in the following example, this would mean that the burners 5 and 6 are switched on in the next step. After switching on burners 5 and 6, the burners 1, 2, 5 and 6 are in operation.

A glance at FIG. 1 shows that the described switching on of the burners 5 and 6 in addition to the burners 1 and 2 that are already in operation has the effect of ensuring uniform firing of the combustion chamber 15, since, given the spatial arrangement of the burners according to FIG. 1, in this way opposing pairs of burners with respect to the center point of the combustion chamber 15 are operated, which leads to uniform firing of the combustion chamber 15 and consequently to economical operation of the technical installation.

The assessment principle represented in FIG. 2 can be easily generalized: a certain burner is chosen as the reference burner and a first, a second and a third neighboring pair of burners are defined in relation to it. With respect to the burner 3, the first neighboring pair of burners defined in this way is the pair of burners formed by the burners 2 and 4, the second pair of burners is the pair of burners formed by the burners 5 and 1 and the third neighboring pair of burners is the pair of burners formed by the burners 6 and 8.

If the burner 3 then commences to operate, it triggers for example an assessment of the burners 2 and 4 with the value six, an assessment of the burners 5 and 1 with the value three and an assessment of the burners 6 and 8 with the value one. If another burner commences to operate, this is chosen as the reference burner and forms in an analogous way a further first neighboring pair of burners, a further second neighboring pair of burners and a further third neighboring pair of burners.

In FIG. 3, an exemplary embodiment of the processing unit 35 from FIG. 2 is represented.

The current assessments 40 are in this case switched to a selection module AB of the processing unit 35; in addition, an auxiliary value may also have been switched and is used, for example, by the selection module AB for the purpose of also determining burners that are to be switched on or off whenever the evaluation of the current assessments 40 is not possible, for example because of a fault. In parallel with their switching to the selection module AB, the current assessments 40 are respectively passed as a threshold 44 to a respective threshold-value module SB.

The selection module AB may then be designed, for example, as a minimum-value module, which selects the minimum from the current assessments 40 and passes this as its output signal to the summator 42 as an input signal. The summator 42 combines the output of the selection module AB with a constant K to form a sum, which is simultaneously switched to the inputs of all the threshold-value modules SB. Since the thresholds 44 belonging to the respective threshold-value modules differ in their values, the input signal for all the threshold-value modules SB is the same, only those threshold-value modules in which the input signal raised by the constant K exceeds the value of the respectively associated threshold supply an output signal which is not equal to zero as commands Z1, Z2, Z3, . . . Z8.

The previously described specific form of the selection module AB as a minimum-value module can be used particularly advantageously when determining components to be switched on of the technical installation. For determining components to be switched off of the technical installation, the selection module AB is preferably formed as a maximum-value module. It is consequently ensured that—if the assessment is carried out in a way similar to that described in FIG. 2—those components which have the greatest value as current assessments 40 are determined as components to be switched off in the next step.

Exemplary embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A method for operating a combustion installation including a number of components, comprising:

assessing at least one component with a numerical value as components commence or cease to operate;

summing numerical values of each assessed component; and determining which components are to be switched on or off from the summed numerical values;

wherein a symmetrical spatial distribution of operational components is achieved by switching on or off components;

wherein components respectively arranged at the same spatial distance from a component commencing or ceasing to operate are assessed with the same numerical value.

2. The method as claimed in claim 1, wherein the components are of the same type.

3. The device as claimed in claim 1, wherein the combustion installation is for generating electrical energy.

4. A device for operating a combustion installation including a number of components, comprising:

at least one arithmetic unit for storing a number of numerical values respectively assigned to a component, the arithmetic unit capable of triggering an assessment of a component with a numerical value when another component commences or ceases to operate, capable of summating numerical values of components, and capable of determining from the summated numerical values of components which are subsequently to be switched on or off;

wherein a symmetrical spatial distribution of operational components is achieved by switching on or off components, and wherein components respectively arranged at the same spatial distance from a component commencing or ceasing to operate are assessed with the same numerical value.

5. The device as claimed in claim 4, the components are of the same type.

6. The device as claimed in claim 4, wherein the combustion installation is for generating electrical energy.

* * * * *